United States Patent [19]

Mizuta et al.

[11] 4,304,484

[45] Dec. 8, 1981

[54] UNIFORM DEVELOPING METHOD OF A FILM FOR USE IN AN AUTOMATIC DEVELOPER

[75] Inventors: Masaji Mizuta, Uji; Atsushi Yoshida, Kyoto, both of Japan

[73] Assignee: Dainippon Screen Seizo Kabushiki Kaisha, Kyoto, Japan

[21] Appl. No.: 185,231

[22] Filed: Sep. 8, 1980

[30] Foreign Application Priority Data

Aug. 20, 1979 [JP] Japan ..... 54-115185

[51] Int. Cl.[3] ..... G03D 3/13

[52] U.S. Cl. ..... 354/321; 134/57 R; 134/122 P

[58] Field of Search ..... 354/297, 298, 319, 320, 354/321, 322, 324; 134/57 R, 58 R, 64 P, 122 P

[56] References Cited

U.S. PATENT DOCUMENTS 2,296,048 9/1942 Planskoy ..... 354/298

OTHER PUBLICATIONS

Lawson, European Patent Application, # 78300279.3, 7-3-79.

*Primary Examiner*—L. T. Hix
*Assistant Examiner*—Alan Mathews
*Attorney, Agent, or Firm*—John Cyril Malloy

[57] ABSTRACT

A uniform developing method of a film for use in an automatic developer in which the film light-exposed is moved in developing solution in a developing vessel, wherein the moving speed of the film is gradually reduced depending on a deterioration rate of the developing solution with respect to the length of the film to be developed.

3 Claims, 4 Drawing Figures

UNIFORM DEVELOPING METHOD OF A FILM FOR USE IN AN AUTOMATIC DEVELOPER

BACKGROUND OF THE INVENTION

This invention relates to a uniform developing method of a film for use in an automatic developer.

In an automatic developer a film light-exposed is processed consecutively by passing it through developing, fixing and washing vessels. In this case, as the development proceeds, the activity of the developing solution in the developing vessel is lowered. Accordingly, when a long film is processed at a fixed speed in such an automatic developer, the finishes of the first and the last parts of the film are different, resulting in uneven reproduction pictures, which deteriorates the quality of the film finished.

In the prior art, while the film is developed, the depression of the activity of the developing solution is prevented by supplementing the fresh developing solution little by little, thereby making the development of the film uniform.

However, in this method, it is difficult to grasp the necessary amount of the fresh developing solution corresponding to the lowering of the activity of the developing solution and the timing of the supplementation of the fresh developing solution. Further, the fresh developing solution supplemented should be mixed uniformly with the previous developing solution immediately. In this case, after finishing the developing of the film, the developing solution still having the activity enough to develop the film will be drained away when there is no further film to be developed, which is quite uneconomical.

SUMMARY OF THE INVENTION

It is an object of the present invention to provide a uniform developing method of a film for use in an automatic developer free from the aforementioned defects, which compensates the lowering of the activity of the developing solution and which is economical and reliable.

According to the present invention there is provided a uniform developing method of a film for use in an automatic developer wherein the film light-exposed is moved in a developing solution in a developing vessel, characterized in that the moving speed of the film is gradually reduced depending on a deterioration rate of the developing solution with respect to the length of the film to be developed.

BRIEF DESCRIPTION OF DRAWINGS

In order that the present invention may be better understood, preferred embodiments will be described with reference to the accompanying drawings, in which.

DESCRIPTION OF PREFERRED EMBODIMENTS

Figure 1:
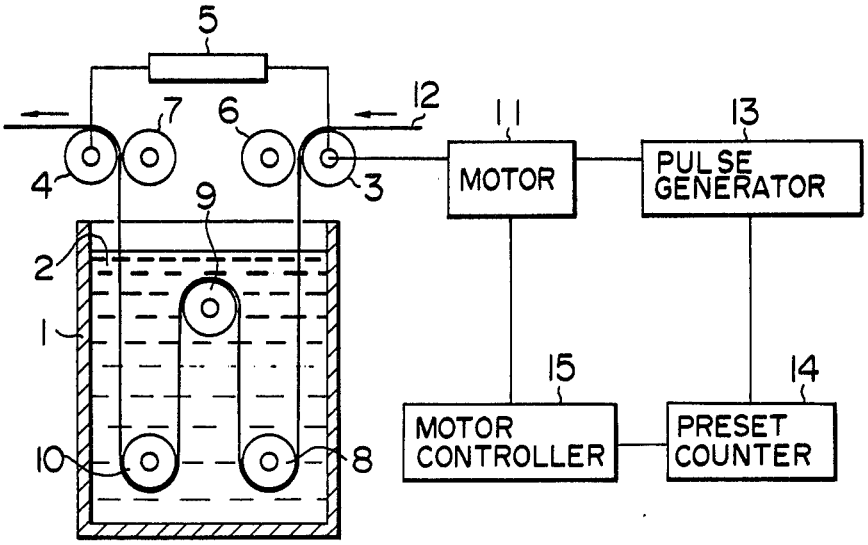
FIG. 1 is a schematic view of an essential part of an automatic developer for explaining the first embodiment of a method according to the present invention.

Referring now to the drawings there is shown in FIG. 1 an essential part of an automatic developer which performs one embodiment of a method according to the present invention.

A developing solution vessel 1 contains a developing solution 2. A pair of drive rollers 3 and 4 for moving a film 12 are driven by a motor 11 and are coupled each other by a coupling means 5 so as to be rotated synchronously. A pair of rollers 6 and 7 are the backing rollers of the drive rollers 3 and 4, and transfer rollers 8, 9 and 10 are positioned in the developing vessel 1.

The film 12 is moved down through between the rollers 3 and 6 into the developing solution 2, while it is developed, is turned around the transfer rollers 8, 9 and 10, is come out of the developing solution 2, and then is passed through between the rollers 4 and 7. The film 12 developed is then transferred consecutively to fixing and washing vessels (not shown).

In this embodiment, the motor 11 is provided with a pulse generator 13 which generates pulses corresponding to the rotation numbers of the drive shaft of the motor 11. The pulses generated by the motor 11 are sent to a preset counter 14 which counts the pulse number of the pulses and outputs a motor speed control signal corresponding to a deterioration curve predetermined of the developing solution according to the integral pulse number which is proportional to a moving distance of the film 12.

The deterioration curve of the developing solution is obtained by an experiment or a calculation depending on the characteristics of the developing solution, the volume of the developing solution contained in the developing vessel, the width of the film to be developed, and so forth.

For example, in the apparatus shown in FIG. 1 a sampling film 12 equally exposed is developed by continuously moving in the developing solution 2 at a certain speed by the motor 11, and then the densities of the developed sampling film in its certain points corresponding to the integral pulse numbers (distances away from the tip of the film, obtained by multiplying the integral pulse numbers to the moving distance of the film per one pulse) are measured, thereby obtaining the deterioration curve. One example of such a deterioration curve $A_1$ of the developing solution is shown in FIG. 2 wherein the initial density of the sampling film is 100.

Figure 2:
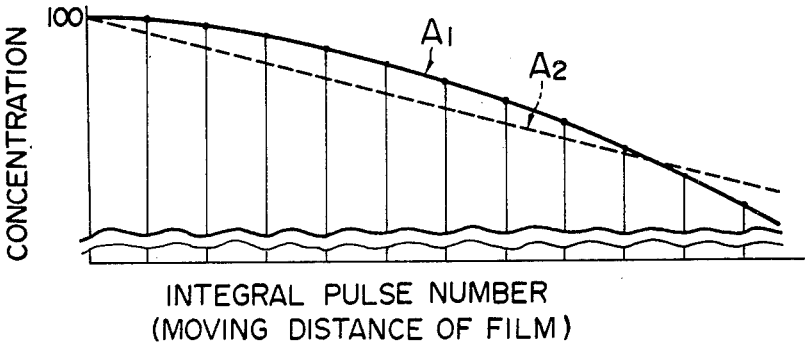
FIG. 2 shows one embodiment of a deterioration curve of a developing solution shown in FIG. 1.
Figure 3:
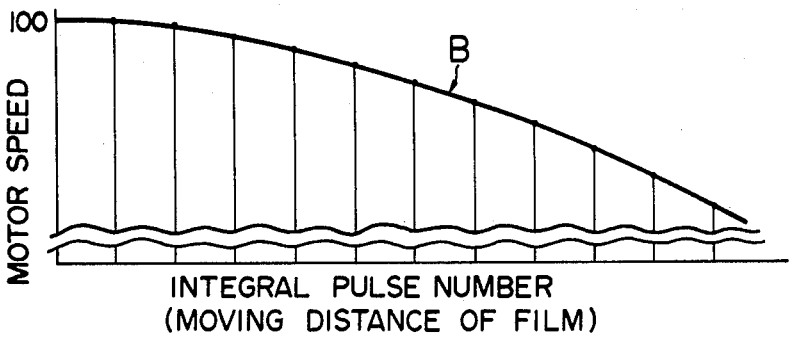
FIG. 3 shows one embodiment of a motor speed curve corresponding to the curve in FIG. 2.

A motor speed curve B obtained according to the deterioration curve $A_1$ of FIG. 2 is shown in FIG. 3 wherein the initial motor speed is 100. In the motor speed curve B, as the integral pulse number increases, the motor speed decreases in the same proportion to the deterioration curve $A_1$ in FIG. 2. The motor speed control signal is obtained by picking up a motor speed corresponding to the integral pulse number along the motor speed curve B.

The motor speed control signal is sent to a motor controller 15 and the motor controller 15 controls the motor 11 according to the motor speed control signal so that the speed of the motor 11 may be reduced gradually.

In this embodiment, by minimizing the pitch of the pulse generated by the pulse generator 13 the motor speed, i.e. the moving speed of the film 12 may substantially be varied continuously. On the other hand, the motor speed may be varied step by step by increasing the pitch of the pulse or by the motor speed control signal predetermined, which corresponds to one division including some pulses.

Figure 4:
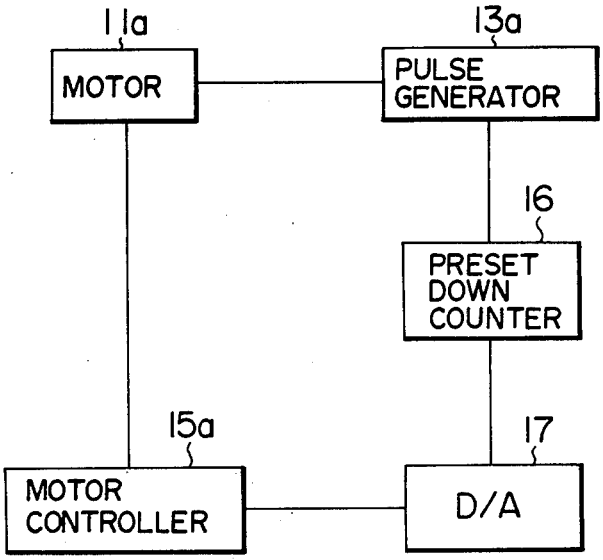
FIG. 4 is a block diagram of another motor control circuit for moving a film of the automatic developer for explaining the second embodiment of a method according to the present invention.

In FIG. 4 there is shown another motor control circuit for moving the film of the automatic developer for the explanation of the second embodiment of the method according to the present invention.

In this embodiment, a motor 11*a* similar to the motor 11 of FIG. 1 is provided with a pulse generator 13*a* similar to the pulse generator 13 of FIG. 1, which generates pulses corresponding to the motor speeds and sends them to a preset down counter 16.

The preset down counter 16 in which a maximum pulse number $C_{max}$ corresponding to the length of the film to be developed is settled, subtracts an integral pulse number C generated by the pulse generator 13*a* from the maximum pulse number $C_{max}$ and sends a signal corresponding to the difference $(C_{max}-C)$ to a digital-analog converter 17, hereinafter referred to as a D/A converter.

The D/A converter 17 converts the signal corresponding to $(C_{max}-C)$ into a voltage signal which is, as occasion demands, added by a desired bias voltage, and then is sent to a motor controller 15*a* similar to the motor controller 15 of FIG. 1.

The motor controller 15*a* controls the motor 11*a* according to the signal sent from the D/A converter 17 so as to reduce the motor speed depending on the moving distance of the film.

In this embodiment, for example, the motor speed is substantially varied along a motor speed line corresponding to a deterioration line $A_2$ which is shown by a broken line in FIG. 2, by setting the maximum pulse number $C_{max}$. In practice, if the deterioration line $A_2$ is in the acceptable limit range of the deterioration curve $A_1$, the motor speed may be controlled linearly according to the deterioration line $A_2$. In this case, the motor speed may be easily varied and the maximum pulse number is also determined easily.

Although the present invention has been shown and described in terms of preferred embodiments, however, various changes and modifications can be made by a person skilled in the art without departing from the scope of the present invention.

What is claimed is:

1. A uniform film developing method for use in an automatic developer wherein light exposed film is moved by speed controlled motor driven feed rollers in a developing solution in a developing vessel and said automatic developer includes motor means, speed control means for said motor, feed roller means and motor rpm countermeasures, said method comprising the steps of:

first, determining the deterioration rate of said developer solution per linear feet of travel of film through the solution expressed in rpm's of the motor, moving said light exposed film continuously in the developing solution in said developing vessel, sensing the number of rpm's of travel in the solution, and simultaneously adjusting said speed control means to control the speed of said film moving through said solution by controlling the feed roller means speed and rpm's of the motor means gradually reducing the moving speed of the film in accordance with the deterioration rate of said developing solution corresponding to the length of film passing through said developing solution.

2. The method as set forth in claim 1 wherein said reducing step is carried out by controlling the rpm's of said motor means by means of a motor speed control signal means corresponding to the deterioration rate, said motor speed control signal being generated according to an integral pulse number of pulses generated by a pulse generator means corresponding to the rotation numbers of said motor.

3. The method as set forth in claim 1 wherein said reducing step comprises reducing the linear movement of the film according to the deterioration rate of the developing solution in accordance with the deterioration rate by controlling the speed of said motor means utilizing a voltage control means corresponding to a difference $(C_{max}-C)$ which is obtained by subtracting an integral pulse number C of pulses generated by a pulse generator corresponding to the rotation numbers of said motor from a maximum pulse number $C_{max}$ corresponding to the entire length of said film to be developed.

* * * * *